US009873271B2

(12) United States Patent
Iijima

(10) Patent No.: US 9,873,271 B2
(45) Date of Patent: Jan. 23, 2018

(54) INK-JET RECORDING APPARATUS

(71) Applicant: BROTHER KOGYO KABUSHIKI KAISHA, Nagoya-shi, Aichi-ken (JP)

(72) Inventor: Shota Iijima, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 15/470,560

(22) Filed: Mar. 27, 2017

(65) Prior Publication Data

US 2017/0355203 A1 Dec. 14, 2017

(30) Foreign Application Priority Data

Jun. 10, 2016 (JP) ..... 2016-116546

(51) Int. Cl.

| | |
|---|---|
| ***B41J 2/01*** | (2006.01) |
| ***B41J 13/00*** | (2006.01) |
| ***B41J 13/03*** | (2006.01) |
| ***B41J 2/045*** | (2006.01) |
| ***B41J 25/308*** | (2006.01) |
| ***B41J 11/00*** | (2006.01) |

(52) U.S. Cl.

CPC ..... *B41J 13/009* (2013.01); *B41J 2/04573* (2013.01); *B41J 11/008* (2013.01); *B41J 13/03* (2013.01); *B41J 25/308* (2013.01)

(58) Field of Classification Search

CPC ..... B41J 13/009; B41J 13/03; B41J 2/04573; B41J 25/308; B41J 11/008

USPC ..... 347/5, 8, 9, 16, 101, 104

See application file for complete search history.

(56) References Cited

U.S. PATENT DOCUMENTS

| | | | | |
|---|---|---|---|---|
| 8,955,938 | B2 * | 2/2015 | Kobayashi | B41J 2/04501 347/14 |
| 9,096,086 | B2 * | 8/2015 | Sano | B41J 11/007 |
| 9,162,492 | B2 * | 10/2015 | Iijima | B41J 13/0009 |

FOREIGN PATENT DOCUMENTS

| | | |
|---|---|---|
| JP | 2008-110529 A | 5/2008 |
| JP | 2013-199132 A | 10/2013 |

* cited by examiner

*Primary Examiner* — An Do

(74) *Attorney, Agent, or Firm* — Merchant & Gould P.C.

(57) ABSTRACT

An image recording apparatus, including: a main body; an image recorder; a sheet supporter movable between an opposed position and a retracted position; a cap movable between a contact position and a distant position; a distance-defining member movable between a first position and a second position and configured to define a distance between an upper surface of a sheet and a lower surface of the recorder, the first position being a position where the member partially overlaps a region of the cap at the contact position, the second position being a position where at least a part of the member does not overlap the region; and a controller to control the cap to move from the distant position to the contact position after the supporter has been moved from the opposed position to the retracted position and the member has been moved from the first position to the second position.

18 Claims, 11 Drawing Sheets

INK-JET RECORDING APPARATUS

The present application claims priority from Japanese Patent Application No. 2016-116546, which was filed on Jun. 10, 2016, the disclosure of which is herein incorporated by reference in its entirety.

BACKGROUND

Technical Field

The present disclosure relates to an ink-jet recording apparatus configured to record an image on a sheet by ejecting ink from nozzles.

Description of Related Art

There has been known an ink-jet recording apparatus configured to record an image on a sheet by ejecting ink from nozzles formed in a recording head. In an instance where the ink-jet recording apparatus includes recording heads of a line type for recording an image on the sheet at a high speed, ink attaching positions on the sheet are determined by a conveyance speed of the sheet that is conveyed through a conveyance path formed in the apparatus, an ink ejection speed, and a distance between the nozzles and the sheet. In this instance, if the sheet floats above from a platen which supports the sheet, at a position at which the sheet is opposed to the nozzles, the distance between the sheet and the nozzles changes, so that the ink attaching positions deviate from intended positions, resulting in a deterioration of the recorded image. Further, if an end portion of the sheet is caught by the recording head, the conveyance speed of the sheet changes, causing a risk of an adverse influence on the quality of the recorded image.

To solve the problems indicated above, a technique of keeping the distance between the nozzles and the sheet constant is known. For instance, there has been known an ink-jet recording apparatus having a contact member configured to come into contact with the sheet between the recording head and the platen.

In some ink-jet recording apparatus, when a maintenance operation of the recording head is performed in the ink-jet recording apparatus, the nozzles of the recording head need to be covered by a cap. In the ink-jet recording apparatus, the cap is retracted from the vicinity of the nozzles when an image recording operation is performed on the sheet. When the maintenance operation of the recording head is performed, the cap is moved to a nozzle covering position at which the cap covers the nozzles.

SUMMARY

It is preferable that the above-indicated contact member, as one example of a member for keeping the distance between the nozzles and the sheet constant, extend to the vicinity of the nozzles for preventing a change in the distance between the sheet and the nozzles due to floating of the sheet. If the contact member extends to the vicinity of the nozzles, however, the contact member disturbs the movement of the cap to the nozzle covering position. Thus, it is impossible in the known ink-jet recording apparatus to extend the contact member to the vicinity of the nozzles.

One aspect of the present disclosure provides an ink-jet recording apparatus in which nozzles can be covered by a cap even where a member for keeping a distance between the nozzles and a sheet constant is disposed in the vicinity of the nozzles.

In one aspect of the disclosure, an image recording apparatus includes: a main body in which is formed a conveyance path through which a sheet is conveyed; an image recorder disposed in the main body and having nozzles through which a liquid is ejected toward the conveyance path; a sheet supporter movable between (a) an opposed position at which the sheet supporter is opposed to the image recorder so as to partly define the conveyance path and supports the sheet located at the conveyance path and (b) a retracted position at which the sheet supporter is retracted from the opposed position so as not to partly define the conveyance path; a cap movable between (c) a contact position at which the cap is located at the conveyance path and held in contact with a lower surface of the image recorder so as to cover the nozzles and (d) a distant position at which the cap is retracted from the conveyance path and distant from the lower surface of the image recorder; a distance-defining member movable between (e) a first position and (f) a second position, the distance-defining member located at the first position being configured to define a distance between an upper surface of the sheet and the lower surface of the image recorder, the first position being a position at which at least a part of the distance-defining member is located between the lower surface of the image recorder and the sheet supporter and at which at least a part of the distance-defining member overlaps a region of the cap located at the contact position, the second position being a position at which at least a part of the distance-defining member does not overlap the region of the cap located at the contact position; and a controller configured to control the cap to move from the distant position to the contact position after the sheet supporter has been moved from the opposed position to the retracted position and the distance-defining member has been moved from the first position to the second position, wherein the distance-defining member located at the first position is supported by the sheet supporter located at the opposed position, and the distance-defining member located at the first position is moved to the second position by moving the sheet supporter from the opposed position to the retracted position.

BRIEF DESCRIPTION OF THE DRAWINGS

The objects, features, advantages, and technical and industrial significance of the present disclosure will be better understood by reading the following detailed description of one embodiment, when considered in connection with the accompanying drawings, in which.

DETAILED DESCRIPTION OF THE EMBODIMENT

Figure 1:
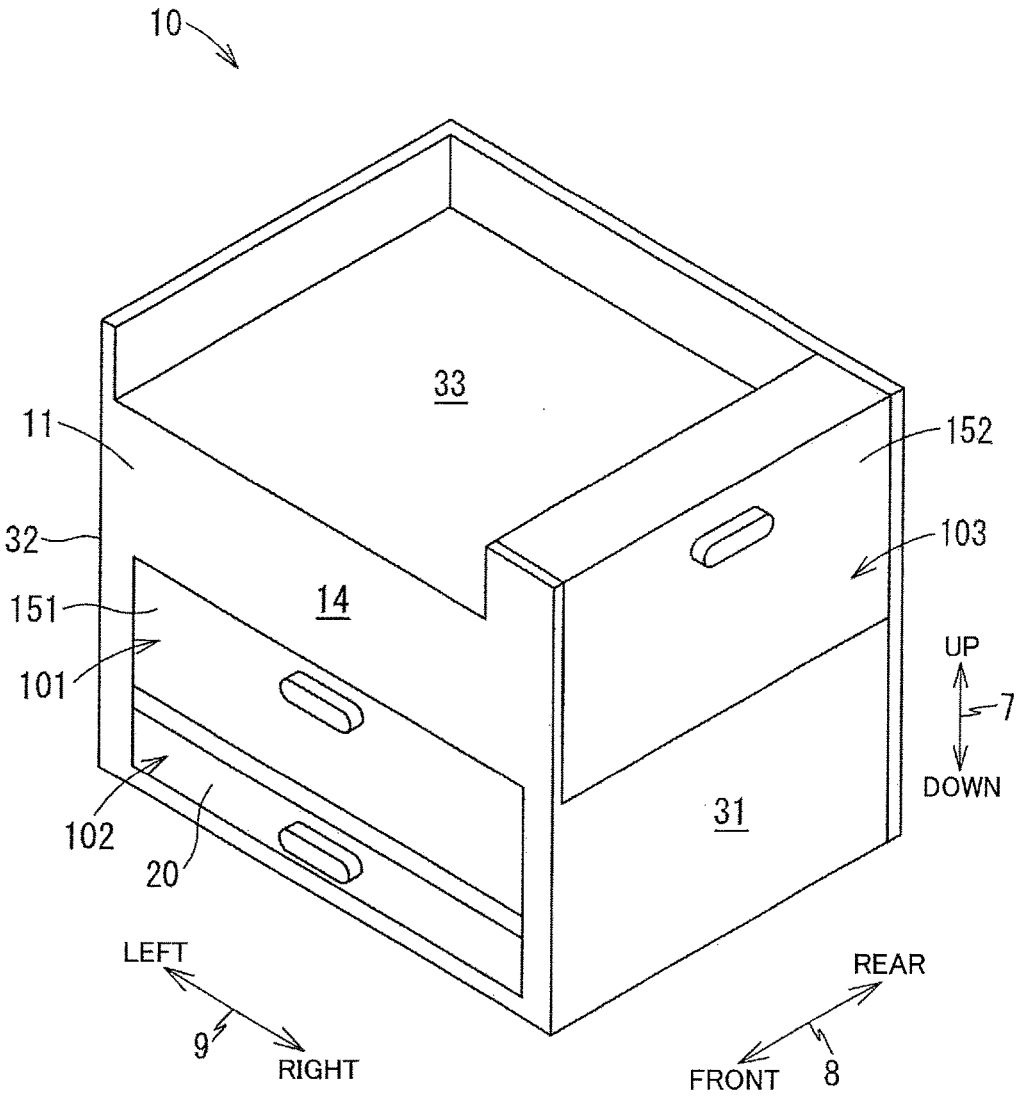
FIG. 1 is a perspective view of an ink-jet printer.

There will be described one embodiment of the present disclosure. It is to be understood that the following embodiment will be described for illustrative purpose only and that the present disclosure may be otherwise embodied. In the following description, an up-down direction 7 is defined with respect to an attitude of an ink-jet printer 10 placed in its operative position shown in FIG. 1, and a front-rear direction 8 is defined regarding a side of the ink-jet printer 10 on which openings 101, 102 are formed as a front side (a front surface 14), and a right-left direction 9 is defined in a state in which the ink-jet printer 10 is viewed from the front side. The up-down direction 7, the front-rear direction 8, and the right-left direction 9 are orthogonal to each other.

Overall Structure of Ink-Jet Printer 10

As shown in FIG. 1, the ink-jet printer 10 (as one example of "image recording apparatus") includes a housing 11 (as one example of "main body") having a generally rectangular parallelepiped shape. The ink-jet printer 10 has a function of recording an image on one surface of a sheet 12 (FIG. 2) according to an ink-jet recording method. The ink-jet printer 10 may be configured to record an image on both surface of the sheet 12.

The ink-jet printer 10 has the openings 101, 102 formed in its front surface 14. The opening 101 is located above the opening 102.

A first door 151 is disposed in the opening 101 so as to be openable and closable about a horizontal shaft provided at a lower end of the first door 151. An image recorder 24 and a sheet supporter 23 (FIG. 2) are disposed at a position in the housing 11 at which the image recorder 24 and the sheet supporter 23 are opposed to the opening 101 in the front-rear direction 8. In this configuration, when the sheet 12 is jammed between the image recorder 24 and the sheet supporter 23, a user opens the first door 151 and makes access between the image recorder 24 and the sheet supporter 23, thereby removing the jammed sheet 12.

Figure 2:
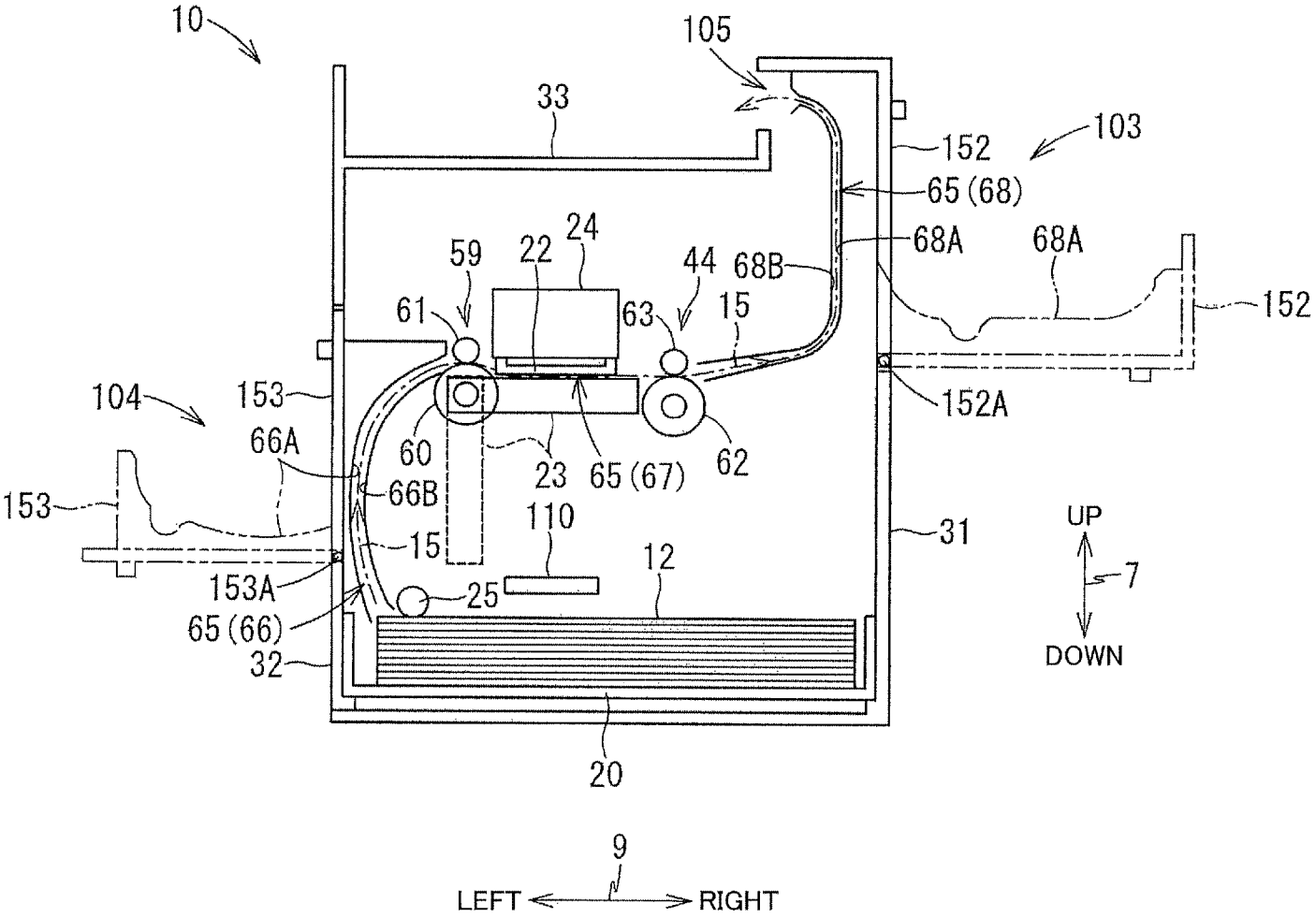
FIG. 2 is an elevational view in vertical cross section schematically showing an inner structure of the ink-jet printer.

A sheet tray 20 is disposed in the opening 102. The sheet tray 20 is insertable into and removable from the housing 11 through the opening 102 by being moved in the front-rear direction 8. The sheet tray 20 is shaped like a box opening upward. As shown in FIG. 2, the sheet tray 20 supports the sheets 12 in a stacked state.

As shown in FIG. 1, the ink-jet printer 10 has an opening 103 formed in its right surface 31. A second door 152 is disposed in the opening 103 so as to be openable and closable about a horizontal shaft 152A (FIG. 2) provided at a lower end of the second door 152. As shown in FIG. 2, the second door 152 has an outer surface 68A that partially defines a discharge path 68 of a conveyance path 65 explained below. In this configuration, when the sheet 12 is jammed in the discharge path 68, the user opens the second door 152 and makes access to the discharge path 68, thereby removing the jammed sheet 12.

As shown in FIG. 2, the ink-jet printer 10 has an opening 104 formed in its left surface 32. A third door 153 is disposed in the opening 104 so as to be openable and closable about a horizontal shaft 153A provided at a lower end of the third door 153. The third door 153 has an outer surface 66A that partially defines a curved path 66 of the conveyance path 65. In this configuration, when the sheet 12 is jammed in the curved path 66, the user opens the third door 153 and makes access to the curved path 66, thereby removing the jammed sheet 12.

Figure 7:
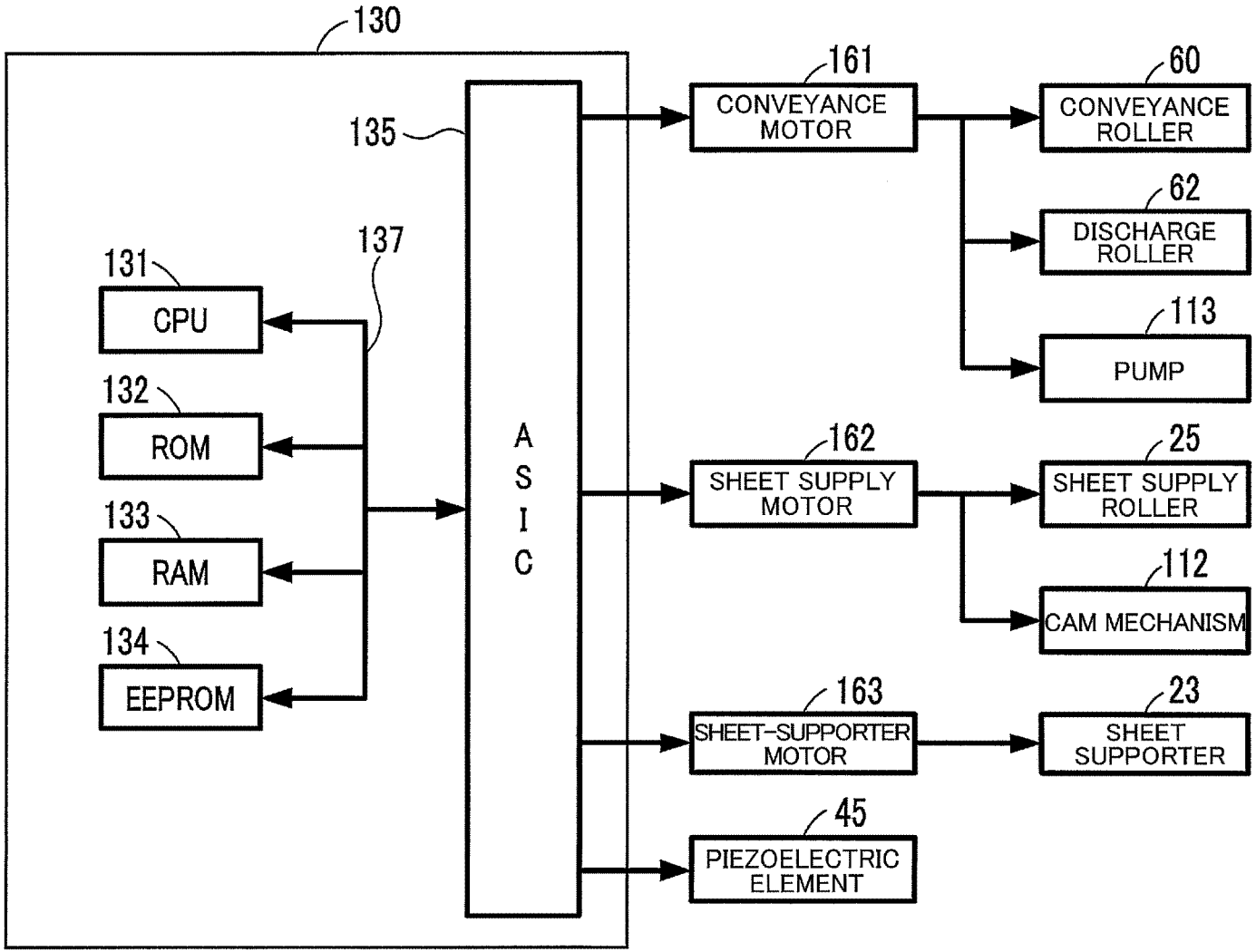
FIG. 7 is a block diagram showing a configuration of a controller.

As shown in FIG. 2, the ink-jet printer 10 includes, in the housing 11, a sheet supply roller 25, the conveyance path 65, a conveyance roller pair 59, a discharge roller pair 44, the image recorder 24, a maintenance mechanism 110, the sheet supporter 23, and a distance-defining member 22. As shown in FIG. 7, the ink-jet printer 10 includes a controller 130.

Sheet Supply Roller 25

As shown in FIG. 2, the sheet supply roller 25 is disposed above a left end portion of the sheet tray 20 installed on the housing 11. The sheet supply roller 25 rotates by a drive force transmitted from a sheet supply motor 162 (FIG. 7). The sheet supply roller 25 rotates in a state in which the sheet supply roller 25 is held in contact with an uppermost one of the sheets 12 supported on the sheet tray 20. The uppermost sheet 12 is supplied by the sheet supply roller 25 to the curved path 66 of the conveyance path 65.

Conveyance Path 65

As shown in FIG. 2, the conveyance path 65 includes the curved path 66, a straight path 67, and the discharge path 68. The curved path 66 extends upward from the left end portion of the sheet tray 20 and makes a U-turn from the left side to the right side. The straight path 67 is continuous from an upper end of the curved path 66. The straight path 67 extends rightward from the upper end of the curved path 66. The discharge path 68 is continuous from a right end of the straight path 67. The discharge path 68 extends upward from the right end of the straight path 67 and makes a U-turn from the right side to the left side. The discharge path 68 is connected, at its upper end, to an upper surface 33 of the housing 11 through the opening 105.

The curved path 66 is defined by the outer surface 66A of the third door 153 and an inner surface 66B facing the outer surface 66A. The straight path 67 is defined by the sheet supporter 23, the distance-defining member 22, and the image recorder 24. The discharge path 68 is defined by the outer surface 68A of the second door 152 and an inner surface 68B facing the outer surface 68A.

The uppermost one of the sheets 12 supported on the sheet tray 20 is supplied by the sheet supply roller 25 to the curved path 66 and reaches the conveyance roller pair 59. The sheet 12 nipped by rollers of the conveyance roller pair 59 is conveyed forward through the straight path 67 to the image recorder 24. The image recorder 24 records an image on the sheet 12 that has reached right under the image recorder 24. The sheet 12 on which the image has been recorded is conveyed through the discharge path 68 by the discharge roller pair 44 and discharged onto the upper surface 33 of the housing 11. In this way, the sheet 12 is conveyed in a conveyance direction 15 indicated by arrows in the long dashed short dashed line in FIG. 2.

Conveyance Roller Pair 59 and Discharge Roller Pair 44

As shown in FIG. 2, the conveyance roller pair 59 is disposed at the straight path 67. The discharge roller pair 44 is disposed at the straight path 67 so as to be located downstream of the conveyance roller pair 59 in the conveyance direction 15.

The conveyance roller pair 59 includes a conveyance roller 60 (as one example of "first roller") and a pinch roller 61 (as one example of "second roller") disposed over the conveyance roller 60 so as to be opposed to the conveyance roller 60. The pinch roller 61 is pressed onto the conveyance roller 60 by an elastic member (not shown) such as a coil spring. Thus, the pinch roller 61 and the conveyance roller 60 can nip the sheet 12 therebetween.

The discharge roller pair 44 includes a discharge roller 62 and a spur roller 63 disposed over the discharge roller 62 so as to be opposed to the discharge roller 62. The spur roller 63 is pressed onto the discharge roller 62 by an elastic member (not shown) such as a coil spring. Thus, the spur roller 63 and the discharge roller 62 can nip the sheet 12 therebetween.

The conveyance roller 60 and the discharge roller 62 rotate by a drive force given by a conveyance motor 161 (FIG. 7). When the conveyance roller 60 rotates with the sheet 12 nipped by the conveyance roller pair 59, the sheet 12 is conveyed in the conveyance direction 15 by the conveyance roller pair 59 and is placed on a platen 42. When the discharge roller 62 rotates with the sheet 12 nipped by the discharge roller pair 44, the sheet 12 is conveyed through the discharge path 68 in the conveyance direction 15 by the discharge roller pair 44 and discharged onto the upper surface 33 of the housing 11.

Image Recorder 24

Figure 3:
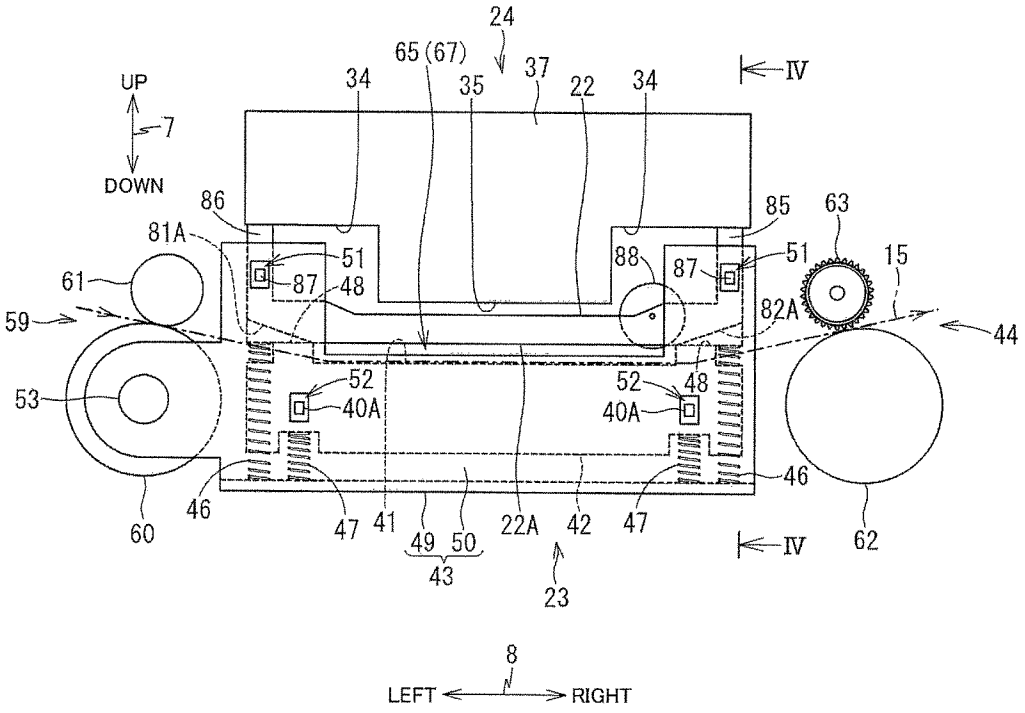
FIG. 3 is an elevational view in vertical cross section schematically showing an image recorder, a distance-defining member located at a first position, a sheet supporter located at an opposed position, a conveyance roller pair, and a discharge roller pair.
Figure 4:
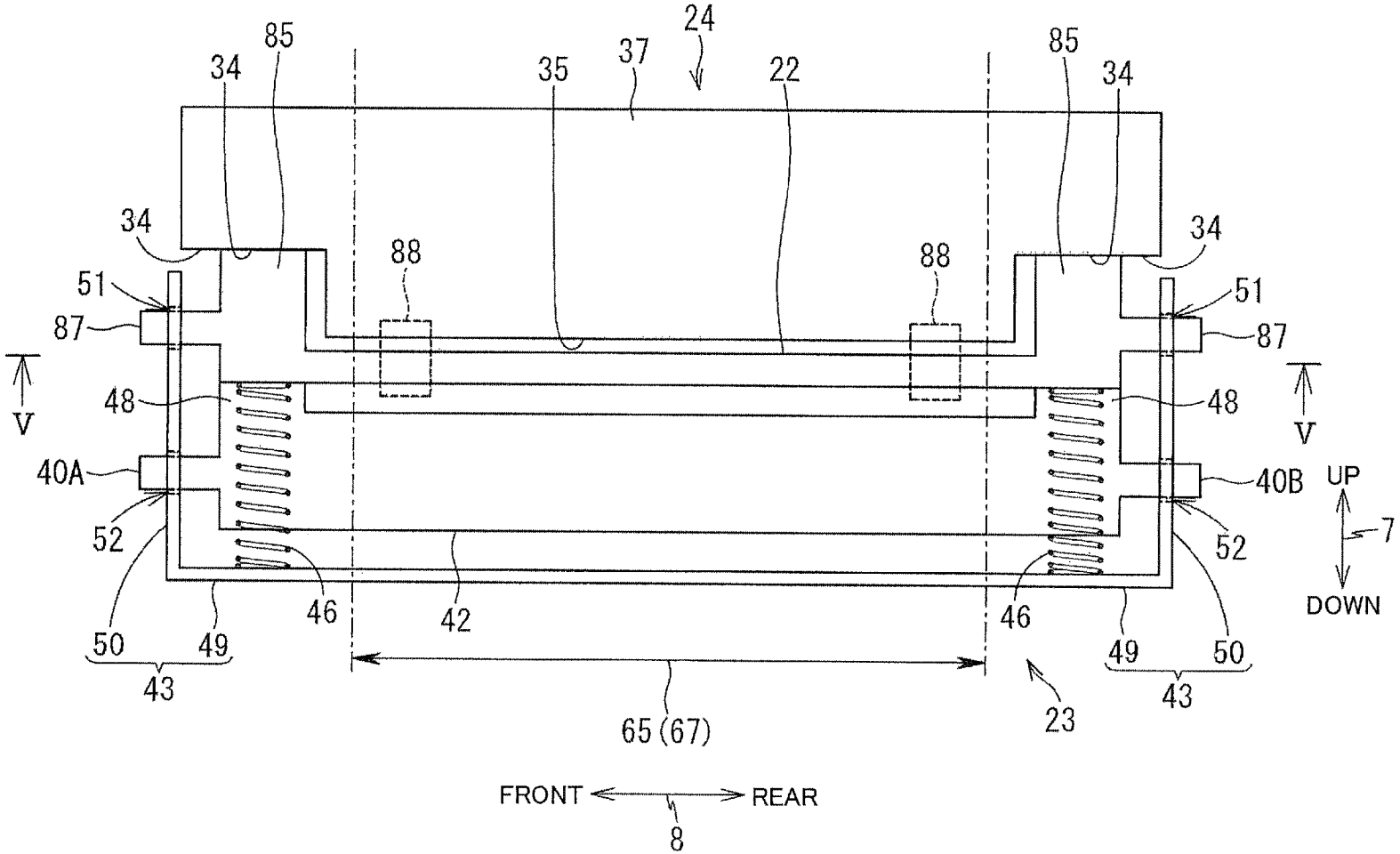
FIG. 4 is a cross-sectional view taken along line Iv-Iv in FIG. 3.
Figure 5:
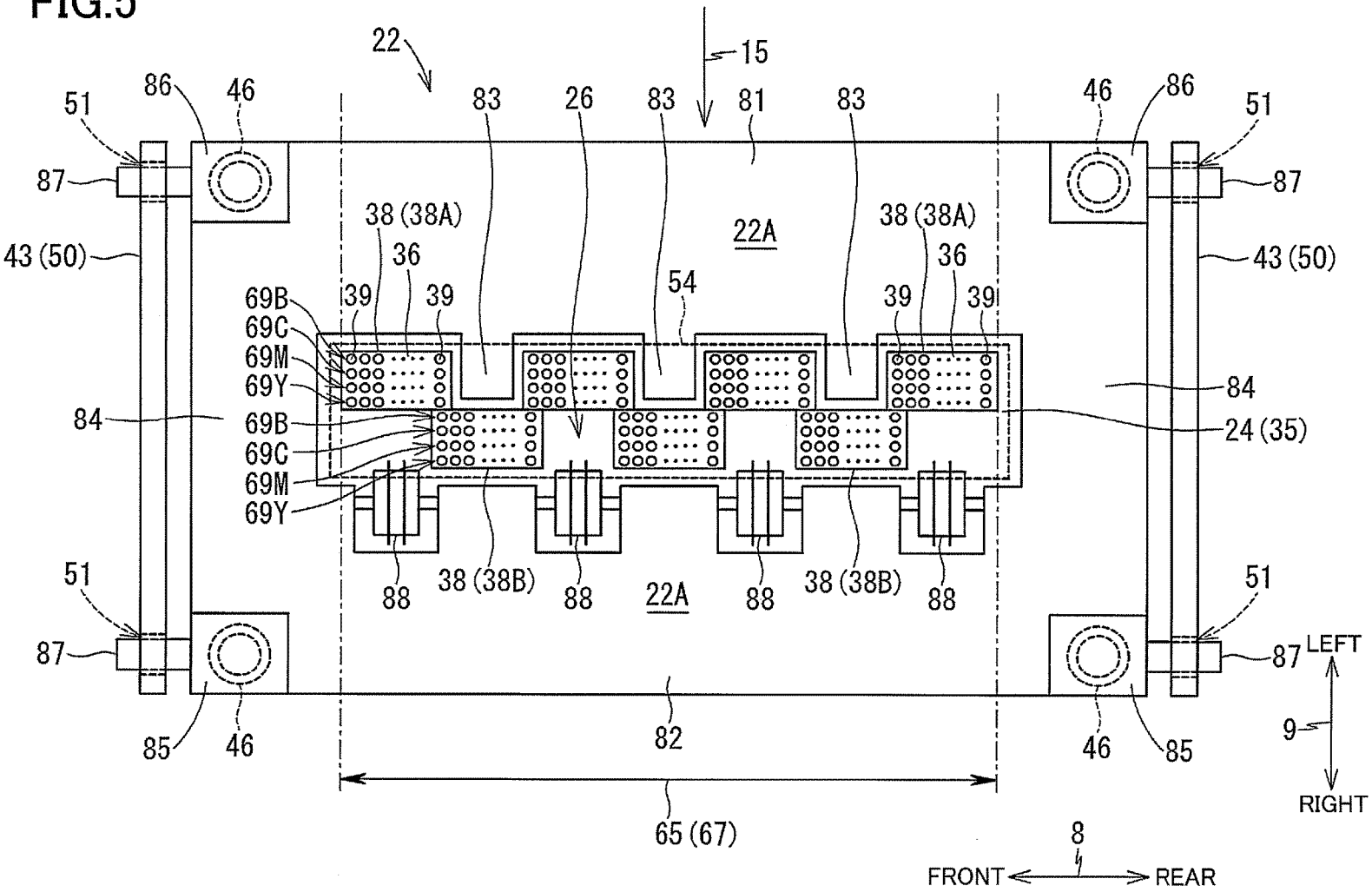
FIG. 5 is a cross-sectional view taken along line v-v in FIG. 4.

As shown in FIG. 2, the image recorder 24 is disposed above the straight path 67. The image recorder 24 is located downstream of the conveyance roller pair 59 in the conveyance direction 15 and upstream of the discharge roller pair 44 in the conveyance direction 15. As shown in FIGS. 3-5, the image recorder 24 includes a frame 37 (FIGS. 3 and 4) and a plurality of recording heads 38 (FIG. 5).

The frame 37 is fixed to the housing 11. The frame 37 continuously extends from the front side of the straight path 67 and the rear side of the same 67. As shown in FIG. 5, the recording heads 38 are fixed to the frame 37 such that lower surfaces 36 of the respective recording heads 38 are exposed to the exterior through an opening (not shown) formed in a second lower surface 35 (which will be explained) of the frame 37. That is, the ink-jet printer 10 is a line type printer.

The frame 37 includes, as its lower surface, a first lower surface 34 and the second lower surface 35 located lower than the first lower surface 34. The first lower surface 34 surrounds the second lower surface 35 when viewed from the up-down direction 7. In the present embodiment, the frame 37 includes a plurality of lower surfaces (i.e., the first lower surface 34 and the second lower surface 35) located at different height levels in the up-down direction 7. The frame 37 may include only one lower surface. A lower surface of the image recorder 24 includes the lower surface (the first lower surface 34 and the second lower surface 35) of the frame 37 and the lower surfaces 36 of the respective recording heads 38. The lower surfaces 36 of the recording heads 38 may be flush with the second lower surface 35. Alternatively, the lower surfaces 36 of the recording heads 38 may be located lower or higher than the second lower surface 35.

Each recording head 38 includes: a plurality of sub tanks (not shown) to which ink in ink cartridges (not shown) is supplied; a plurality of nozzles 39 (FIG. 5) formed in the lower surface 36; ink flow passages (not shown) connecting the sub tanks and the nozzles 39; and piezoelectric elements 45 (FIG. 7) configured to deform a part of the ink flow passages so as to permit ink droplets to be ejected from the nozzles 39. The piezoelectric elements 45 are activated by an electric power supplied by the controller 130 (FIG. 7).

The sub tanks store ink in mutually different colors, i.e., cyan, magenta, yellow, and black. As shown in FIG. 5, nozzle rows 69C, 69M, 69Y, 69B are formed in the lower surface 36 of each recording head 38. The nozzle row 69C is connected to the sub tank for cyan ink. The nozzle row 69M is connected to the sub tank for magenta ink. The nozzle row 69Y is connected to the sub tank for yellow ink. The nozzle row 69B is connected to the sub tank for black ink. Each of the nozzle rows 69C, 69M, 69Y, 69B is constituted by the nozzles 39 arranged in the front-rear direction 8. The nozzle rows 69C, 69M, 69Y, 69B are arranged so as to be spaced apart from each other in the right-left direction 9.

The recording heads 38 include a plurality of first recording heads 38A and a plurality of second recording heads 38B. The image recorder 24 of the present embodiment includes four first recording heads 38A and three second recording heads 38B. The number of the first recording heads 38A is not limited to four, and the number of the second recording heads 38B is not limited to three.

The four first recording heads 38A are disposed so as to be spaced apart from each other in the front-rear direction 8 (as one example of "width direction") which is orthogonal to the conveyance direction 15 and which is parallel to the second lower surface 35 of the frame 37.

The three second recording heads 38B are disposed downstream of the first recording heads 38A in the conveyance direction 15. Each second recording head 38B is disposed between corresponding two of the first recording heads 38A adjacent to each other in the front-rear direction 8. That is, the three second recording heads 38B are disposed so as to be spaced apart from each other in the front-rear direction 8.

When viewed from the right-left direction 9, one end of each of two first recording heads 38A adjacent to each other in the front-rear direction 8 overlaps a corresponding one end of one second recording head 38B interposed therebetween.

The image recorder 24 is controlled by the controller 130 (FIG. 7). When the sheet 12 conveyed by the conveyance roller pair 59 passes under the recording heads 38, the controller 130 controls the piezoelectric elements 45 of the recording heads 38, whereby the ink droplets in the respective colors are ejected downward from the nozzles 39 toward the straight path 67. Thus, an image is recorded on the sheet 12 located in the straight path 67.

Maintenance Mechanism 110

Figure 6B:
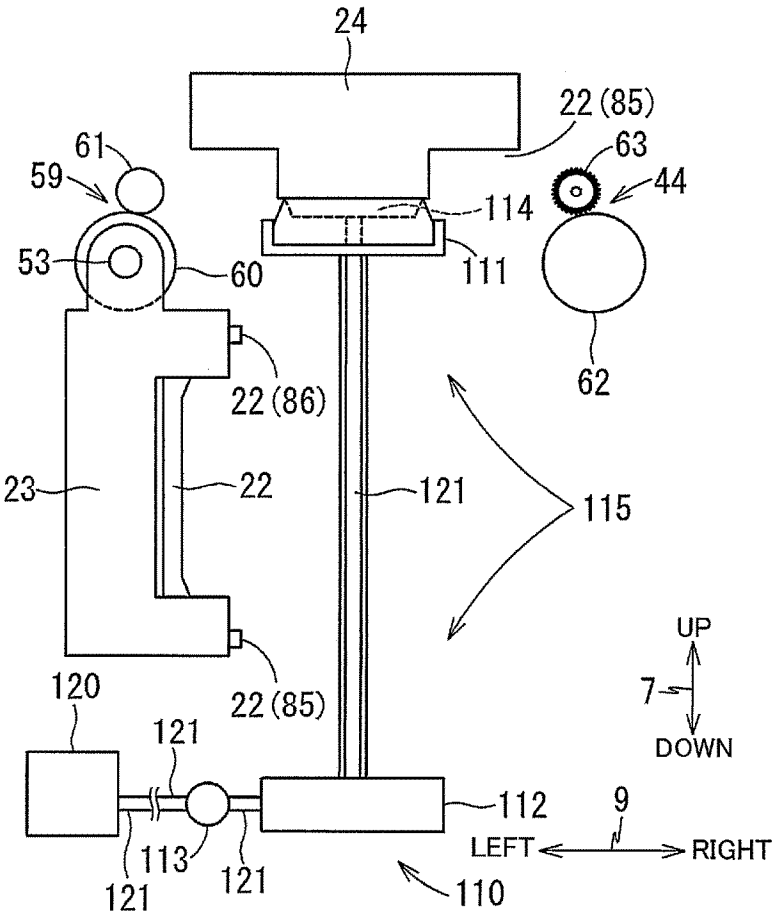
FIGS. 6A and 6B are elevational views in vertical cross section schematically showing the image recorder, the distance-defining member, the sheet supporter, the conveyance roller pair, the discharge roller pair 44, and a maintenance mechanism, FIG. 6A showing a state in which the distance-defining member is located at the first position, the sheet supporter is located at the opposed position, and a cap is located at a distant position, FIG. 6B showing a state in which the distance-defining member is located at a second position, the sheet supporter is located at a retracted position, and the cap is located at a contact position.
Figure 6A:
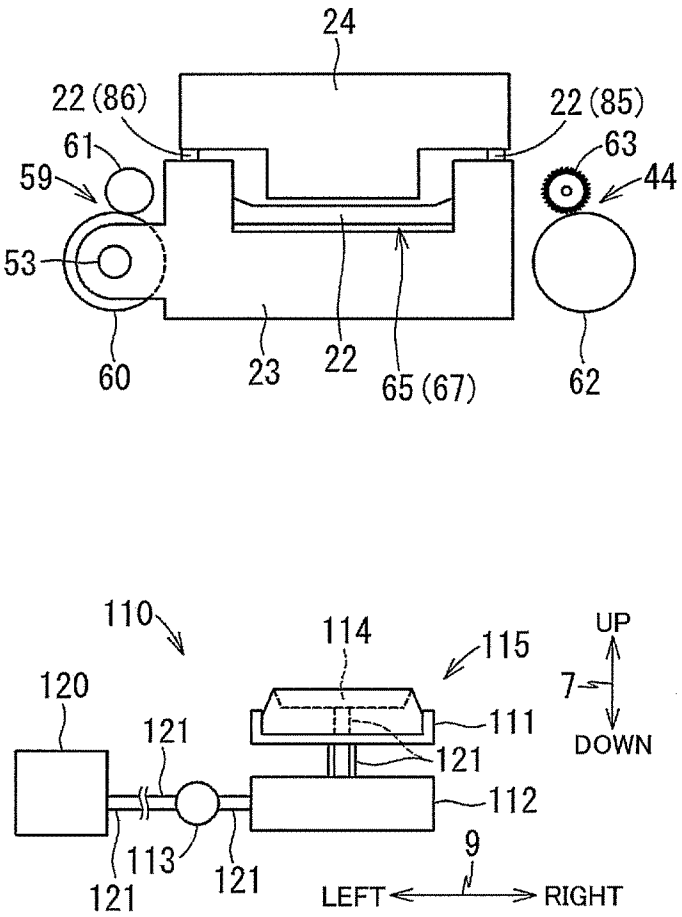

The maintenance mechanism 110 shown in FIGS. 6A and 6B is configured to perform maintenance of the recording heads 38. Specifically, the maintenance mechanism 110 performs a purging operation for sucking the ink and the air in the nozzles 39 and foreign substances attached to the lower surfaces 36 of the recording heads 38. (Hereinafter, the ink and the air in the nozzles 39 and the foreign substances will be collectively referred to as "the ink and the like".) The maintenance mechanism 110 is configured to suck the ink and the like from the nozzles 39 of the recording heads 38 and to discharge the sucked ink and the like to a waste-ink tank 120 via a tube 121.

An ink absorbing member (not shown) is disposed in the waste-ink tank 120. The ink absorbing member absorbs the ink, and the waste-ink tank 120 stores the ink and the like sucked from the nozzles 39. In FIG. 6, the waste-ink tank 120 is schematically illustrated for indicating that the maintenance mechanism 110 and the waste-ink tank 120 are connected by the tube 121. FIG. 6, however, does not show the positional relationship between the waste-ink tank 120 and other constituent components.

The maintenance mechanism 110 includes: a capping mechanism 115 including a movable portion 111 and a cam mechanism 112 (which functions as a first moving mechanism); the tube 121 through which the ink flows; and a pump 113 configured to suck the ink. The cam mechanism 112 is configured to move the movable portion 111 in the up-down direction 7.

The movable portion 111 has a cap 114 formed of a rubber material. The cap 114 is provided so as to be opposed to the recording heads 38 in the up-down direction 7. The cam mechanism 112 is driven by a sheet supply motor 162 (FIG. 7) and moves the movable portion 111 in the up-down direction 7. In the present embodiment, the ink-jet printer 10 includes a switching mechanism configured to switch a destination to which the drive force of the sheet supply motor 162 is transmitted between the cam mechanism 112 and the sheet supply roller 25. The cam mechanism 112 may be driven by a motor other than the sheet supply motor 162. In this case, the switching mechanism is eliminated.

The cap 114 is moved by the cam mechanism 112 that receives the drive force from the sheet supply motor 162 between a contact position (FIG. 6B) at which the cap 114 is held in contact with the lower surfaces 36 of the recording heads 38 so as to cover the nozzles 39 and a distant position (FIG. 6A) at which the cap 114 is spaced apart from the lower surfaces 36 of the recording heads 38 so as not to cover the nozzles 39. The cap 114 at the contact position shown in FIG. 6B is located in the straight path 67. The cap 114 at the distant position shown in FIG. 6A is retracted from the straight path 67 and located lower than the straight path 67.

The dashed line in FIG. 5 indicates a region 54 in which the cap 114 at the contact position is located when viewed from the up-down direction 7. That is, as shown in FIG. 5, the cap 114 at the contact position is capable of covering all of the lower surfaces 36 of the recording heads 38. The region in which the cap 114 at the contact position is located is not limited to the region 54. The cap 114 at the contact position may be held in contact with other portion except the lower surfaces 36 of the recording heads 38. For instance, the cap 114 at the contact position may be held in contact with the first lower surface 34 or the second lower surface 35, so as to cover the nozzles 39.

One end of the tube 121 is connected to the cap 114. The tube 12 is a resin tube having flexibility. The other end of the tube 121 is connected to the waste-ink tank 120. The pump 113 is a tube pump of a rotary type, for instance. The pump 113 is driven by the conveyance motor 161 (FIG. 7), so as to suck the ink and the like in the nozzle 39 through the cap 114 and the tube 121 and to discharge the sucked ink and the like to the waste-ink tank 120 through the tube 121. The ink-jet printer 10 of the present embodiment includes a switching mechanism configured to switch a destination to which the drive force of the conveyance motor 161 is transmitted between: the pump 113; and the conveyance roller 60 and the discharge roller 62. The pump 113 may be driven by a motor other than the conveyance motor 161. In this case, the switching mechanism is eliminated.

Sheet Supporter 23

As shown in FIGS. 3 and 6, the sheet supporter 23 pivots about a shaft 53 so as to be movable between an opposed position shown in FIGS. 3 and 6A and a retracted position shown in FIG. 6B. In FIG. 2, the sheet supporter 23 located at the opposed position is indicated by the solid line, and the sheet supporter 23 located at the retracted position is indicated by the dashed line.

As shown in FIGS. 3 and 6A-6B, the shaft 53 is attached to left ends of a pair of side frames 50 of a support frame 43. The shaft 53 extends in the front-rear direction 8. The shaft 53 is a drive shaft of a sheet-supporter motor 163 (FIG. 7) for pivoting the sheet supporter 23. In the present embodiment, the sheet-supporter motor 163 is a stepping motor. Thus, in a state in which an electric power is supplied to the ink-jet printer 10, the sheet supporter 23 can stay at the opposed position. The sheet-supporter motor 163 is configured to rotate so as to transmit a drive force to the sheet supporter 23 through the shaft 53. With this configuration, the sheet supporter 23 pivots so as to be movable between the opposed position and the retracted position. That is, the sheet-supporter motor 163 and the shaft 53 pivot the sheet supporter 23 between the opposed position and the retracted position. The sheet-supporter motor 163 and the shaft 53 function as a second moving mechanism.

There may be employed, as the sheet-supporter motor 163, a motor other than the stepping motor on the condition that the ink-jet printer 10 is configured to keep the sheet supporter 23 at the opposed position. For instance, on the condition that the ink-jet printer 10 includes a support member for supporting the sheet supporter 23 such that the sheet supporter 23 is kept located at the opposed position in a state in which the sheet supporter 23 is located at the opposed position, other motor except the stepping motor may be employed as the sheet-supporter motor 163.

In the present embodiment, the pivot center of the sheet supporter 23 and the rotation center of the conveyance roller 60 are located on the same straight line, but the shaft 53 of the sheet supporter 23 differs from the shaft of the conveyance roller 60. That is, the sheet supporter 23 and the conveyance roller 60 are given the drive force from different drive sources (the sheet-supporter motor 163 and the conveyance motor 161) and operate independently of each other. The pivot center of the sheet supporter 23 and the rotation center of the conveyance roller 60 may be located on mutually different straight lines.

As shown in FIG. 6A, the sheet supporter 23 when located at the opposed position extends rightward from the shaft 53. The sheet supporter 23 located at the opposed position is disposed such that an upper surface 41 of the platen 42 is opposed to the image recorder 24. In other words, in a state in which the sheet supporter 23 is located at the opposed position, the upper surface 41 of the platen 42 is disposed so as to be opposed to the image recorder 24 with the straight path 67 interposed therebetween. When the sheet supporter 23 is located at the opposed position, the sheet supporter 23 defines a part of the straight path 67. The sheet supporter 23 at the opposed position supports the sheet 12 located in the straight path 67.

As shown in FIG. 6B, the sheet supporter 23 when located at the retracted position extends downward from the shaft 53. When the sheet supporter 23 is located at the retracted position, the sheet supporter 23 is not opposed to the image recorder 24. The sheet supporter 23 at the retracted position does not define the straight path 67 and does not support the sheet 12.

As shown in FIG. 3, the sheet supporter 23 includes the platen 42 configured to support the sheet 12, the support frame 43 that supports the platen 42, first coil springs 46 (each as one example of "first biasing member") that bias the distance-defining member 22, and second coil springs 47 (each as one example of "second biasing member") that biase the platen 42. The following explanation of the sheet supporter 23 will be made based on the understanding that the sheet supporter 23 is located at the opposed position unless otherwise specified.

The platen 42 is disposed so as to be opposed to the second lower surface 35 of the frame 37 of the image recorder 24 and the lower surfaces 36 of the recording heads 38. The platen 42 is a generally flat plate. The platen 42 supports the sheet 12 on its upper surface 41.

The platen 42 has a plurality of protruding portions 48 that protrude upward from the upper surface 41. The protruding portions 48 are located outside the straight path 67 in the front-rear direction 8, namely, located on the front side and the rear side of the straight path 67. The protruding portions 48 are located at an upstream end and a downstream end of the upper surface 41 in the conveyance direction 15. That is, the protruding portions 48 are located respectively at four corners of the platen 42 when viewed from the up-down direction 7.

As shown in FIGS. 3 and 4, the platen 42 has a plurality of protrusions 40A, 40B. The protrusions 40A protrude forward from an upstream end and a downstream end, in the conveyance direction 15, of a front surface of the platen 42. The protrusions 40B protrude rearward from an upstream end and a downstream end, in the conveyance direction 15, of a rear surface of the platen 42.

The support frame 43 includes a bottom frame 49 and the pair of side frames 50. The bottom frame 49 is a plate-like member extending along the front-rear direction 8 and the right-left direction 9. The side frames 50 extend upward respectively from a front end portion and a rear end portion of the bottom frame 49. Each side frame 50 has two elongate holes 51 which are long in the up-down direction 7 and two elongate holes 52 which are long in the up-down direction 7. The elongate holes 51 are located higher than the elongate holes 52.

Lower ends of the first coil springs 46 and the second coil springs 47 are in contact with the bottom frame 49, whereby the first and second coil springs 46, 47 are supported by the bottom frame 49. The first coil springs 46 and the second coil springs 47 are located at right and left ends of the front end portion of the bottom frame 49 and at right and left ends of the rear end portion of the bottom frame 49.

Upper ends of the first coil springs 46 are in contact with the lower surface of the distance-defining member 22. In a state in which the sheet supporter 23 is located at the opposed position, the first coil springs 46 bias the distance-defining member 22 upward, namely, toward the image recorder 24. Protrusions 87 of the distance-defining member 22 are fitted in the respective elongate holes 51, thereby prohibiting the distance-defining member 22 from moving in the right-left direction 9 and the front-rear direction 8. With this configuration, the support frame 43 supports, via the first coil springs 46, the distance-defining member 22 such that the distance-defining member 22 is movable in the up-down direction 7.

Upper ends of the second coil springs 47 are in contact with the lower surface of the platen 42. In a state in which the sheet supporter 23 is located at the opposed position, the second coil springs 47 bias the platen 42 upward, namely, toward the image recorder 24. The protrusions 40A, 40B of the platen 42 are fitted in the respective elongate holes 52, thereby prohibiting the platen 42 form moving in the right-left direction 9 and the front-rear direction 8. With this configuration, the support frame 43 supports, via the second coil springs 47, the platen 42 such that the platen 42 is movable in the up-down direction 7.

As shown in FIG. 3, in the state in which the sheet supporter 23 is located at the opposed position, the protruding portions 48 of the platen 42 are in contact with the distance-defining member 22 from below. In this instance, the second coil springs 47 are shorter than the natural length. That is, the second coil springs 47 are biasing the platen 42 upward, namely, toward the image recorder 24, in the state in which the sheet supporter 23 is located at the opposed position. As described later, in the state in which the sheet supporter 23 is located at the opposed position, the distance-defining member 22 is in contact with the image recorder 24 so as to be positioned in the up-down direction 7. Consequently, in the state in which the sheet supporter 23 is located at the opposed position, the platen 42 is in contact with the distance-defining member 22 so as to be positioned in the up-down direction 7 with respect to the image recorder 24.

Distance-Defining Member 22

The distance-defining member 22 defines a distance between: the upper surface of the sheet 12 located in the straight path 67; and the lower surface of the image recorder 24 (i.e., the first lower surface 34 and the second lower surface 35 of the frame 37 and the lower surfaces 36 of the recording heads 38).

The distance-defining member 22 is shaped like a plate. The distance-defining member 22 is attached to the upper ends of the first coil springs 46, whereby the distance-defining member 22 is supported by the support frame 43 of the sheet supporter 23 via the first coil springs 46. With this configuration, the distance-defining member 22 moves together with the sheet supporter 23 by the pivotal movement of the sheet supporter 23.

The distance-defining member 22 is movable between a first position shown in FIGS. 3 and 6A and a second position shown in FIG. 6B. The distance-defining member 22 is moved from the first position to the second position by the pivotal movement of the sheet supporter 23 from the opposed position to the retracted position. In other words, the sheet-supporter motor 163 and the shaft 53 pivot the sheet supporter 23 such that the sheet supporter 23 is moved from the opposed position to the retracted position, thereby moving the distance-defining member 22 from the first position to the second position.

As shown in FIG. 6A, when the distance-defining member 22 is located at the first position, the distance-defining member 22 extends generally in the front-rear direction 8 and the right-left direction 9. As shown in FIG. 3, the distance-defining member 22 at the first position is located between the lower surface of the image recorder 24 and the platen 42 in the up-down direction 7. While the entirety of the distance-defining member 22 is located between the lower surface of the image recorder 24 and the sheet supporter 23 in the present embodiment, only a part of the distance-defining member 22 may be located between the lower surface of the image recorder 24 and the sheet supporter 23. As shown in FIG. 5, when the distance-defining member 22 is located at the first position, a part of the distance-defining member 22 (i.e., third guides 83 which will be later described) overlaps the region 54 when viewed from the up-down direction 7. The entirety of the distance-defining member 22 located at the first position may overlap the region 54 when viewed from the up-down direction 7.

As shown in FIG. 6B, when the distance-defining member 22 is located at the second position, the distance-defining member 22 extends generally in the front-rear direction 8 and the up-down direction 7. When the distance-defining member 22 is located at the second position, the distance-defining member 22 is retracted from a space between the lower surface of the image recorder 24 and the platen 42 in the up-down direction 7. The distance-defining member 22 at the second position does not overlap the region 54 when viewed from the up-down direction 7.

As shown in FIG. 5, the distance-defining member 22 includes a first guide 81, a second guide 82, the third guides 83, and a fourth guide 84. As shown in FIGS. 3 and 4, the distance-defining member 22 includes first contact portions 85, second contact portions 86, and the protrusions 87. The following explanation of the distance-defining member 22 will be made based on the understanding that the distance-defining member 22 is located at the first position and the sheet supporter 23 is located at the opposed position unless otherwise specified.

As shown in FIG. 5, the distance-defining member 22 has an opening 26. The lower surfaces 36 of the recording heads 38 located above the distance-defining member 22 are visible from below through the opening 26. With this configuration, the ink droplets ejected from the nozzles 39 pass through the opening 26 and reach the straight path 67. An upstream end of the opening 26 in the conveyance direction 15 is defined by the first guide 81 and the third guides 83. A downstream end of the opening 26 in the conveyance direction 15 is defined by the second guide 82. A front end and a rear end of the opening 26 are defined by the fourth guide 84.

The first guide 81 is a portion of the distance-defining member 22 that is located upstream of the nozzles 39 in the conveyance direction 15. As shown in FIG. 3, the first guide 81 has an inclined surface 81A that is inclined downward from the upstream end of the distance-defining member 22 in the conveyance direction 15 to the downstream side. The inclined surface 81A is formed at a position corresponding to the straight path 67 in the front-rear direction 8. The inclined surface 81A guides the sheet 12 that has passed through the conveyance roller pair 59.

As shown in FIG. 5, the second guide 82 is a portion of the distance-defining member 22 that is located downstream of the nozzles 39 in the conveyance direction 15. As shown in FIG. 3, the second guide 82 has an inclined surface 82A that is inclined downward from the downstream end of the distance-defining member 22 in the conveyance direction 15 toward the upstream side. The inclined surface 82A is formed at a position corresponding to the straight path 67 in the front-rear direction 8. The inclined surface 82A guides the sheet 12 to a nipping position of the discharge roller pair 44.

As shown in FIG. 5, the second guide 82 includes four spur rollers 88 arranged so as to be spaced apart from each other in the front-rear direction 8. The number of the spur rollers 88 is not limited to four. Each spur roller 88 is disposed between corresponding two of the second recording heads 38B adjacent to each other in the front-rear direction 8. Each spur roller 88 may be disposed otherwise. The spur rollers 88 are rotatably supported by the distance-defining member 22. Lower ends of the spur rollers 88 pass through the opening 26 and located lower than the lower surface 22A of the distance-defining member 22.

The third guides 83 are portions of the distance-defining member 22 that protrude from a downstream end of the first guide 81 in the conveyance direction 15 toward the downstream side. Three third guides 83 are disposed so as to be spaced apart from each other in the front-rear direction 8. The number of the third guides 83 is not limited to three. Each third guide 83 extends to a position which is between corresponding two of the first recording heads 38A adjacent to each other in the front-rear direction 8 and which is upstream of the corresponding second recording head 38B in the conveyance direction 15. The third guides 83 overlap the region 54 when viewed from the up-down direction 7.

The fourth guide 84 includes: a portion of the distance-defining member 22 which is located rightward of the first guide 81 and leftward of the second guide 82 on the front side of the nozzles 39; and a portion of the distance-defining member 22 which is located rightward of the first guide 81 and leftward of the second guide 82 on the rear side of the nozzles 39. The fourth guide 84 is connected to the first guide 81 at its upstream end in the conveyance direction 15 and connected to the second guide 82 at its downstream end in the conveyance direction 15. With this configuration, the distance-defining member 22 continuously extends from the upstream side of the nozzles 39 to the downstream side of the nozzles 39 in the conveyance direction 15, on the front side and the rear side of the nozzles 39, namely, outside the nozzles 39 in the front-rear direction 8.

As shown FIGS. 3-5, the first contact portions 85 protrude upward from the second guide 82. As shown in FIG. 5, the first contact portions 85 are located respectively at a front end and a rear end of a downstream end portion of the second guide 82 in the conveyance direction 15. That is, two first contact portions 85 are provided. The number of the first contact portions 85 is not limited to two. The first contact portions 85 are located, in the up-down direction 7, between the lower surface of the image recorder 24 (i.e., the first lower surface 34 of the frame 37) and the platen 42. The first contact portions 85 may be located at a position other than that between the lower surface of the image recorder 24 and the sheet supporter 23.

As shown in FIGS. 3 and 5, the second contact portion 86 protrude upward from the first guide 81. As shown in FIG. 5, the second contact portions 86 are located respectively at a front end and a rear end of an upstream end portion of the first guide 81 in the conveyance direction 15. That is, two second contact portions 86 are provided. The number of the second contact portions 86 is not limited to two. The second contact portions 86 are located, in the up-down direction 7, between the lower surface of the image recorder 24 (i.e., the first lower surface 34 of the frame 37) and the platen 42. The second contact portions 86 may be located at a position other than that between the lower surface of the image recorder 24 and the sheet supporter 23.

As shown in FIGS. 3 and 4, the upper ends of first coil springs 46 are in contact with the lower surface of the distance-defining member 22 and the lower ends of the first coil springs 46 are in contact with the bottom frame 49 of the support frame 43. The protrusions 87 protrude rearward and frontward from the first contact portions 85 and the second contact portions 86. The protrusions 87 are fitted in the respective elongate holes 51. With this configuration, the distance-defining member 22 is prohibited from moving in the right-left direction 9 and the front-rear direction 8. Thus, the support frame 43 supports, through the first coil springs 46, the distance-defining member 22 such that the distance-defining member 22 is movable in the up-down direction 7.

In a state in which the distance-defining member 22 is located at the first position, distal end surfaces (i.e., upper surfaces) of the first contact portions 85 and the second contact portions 86 are in contact with the lower surface of the image recorder 24 (i.e., the first lower surface 34 of the frame 37). In this instance, the first coil springs 46 are shorter than the natural length. That is, the first coil springs 46 are biasing the distance-defining member 22 located at the first position upward, namely, toward the image recorder 24. With this configuration, the distance-defining member 22 located at the first position is positioned in the up-down direction 7 relative to the image recorder 24.

In the present embodiment, the distance-defining member 22 is rendered water-repellent. Though whether or not the distance-defining member 22 is rendered water-repellent is optional, it is preferable that the second guide 82 of the distance-defining member 22 located downstream of the nozzles 39 in the conveyance direction 15 be rendered water-repellent.

As shown in FIG. 3, there is a clearance between the lower surface 22A of the distance-defining member 22 and the upper surface 41 of the platen 42. This clearance corresponds to the straight path 67 through which the sheet 12 is conveyed. That is, the straight path 67 is defined by the lower surface 22A of the distance-defining member 22 and the upper surface 41 of the platen 42. In an instance where the sheet 12 floats above the platen 42, the sheet comes into contact with the lower surface 22A of the distance-defining member 22, so that the sheet 12 is prohibited from being positioned higher than the lower surface 22A of the distance-defining member 22. In other words, the distance-defining member 22 defines or limits a distance between the upper surface of the sheet 12 located in the straight path 67 and the lower surface of the image recorder 24 to a distance between the lower surface 22A of the distance-defining member 22 and the lower surface of the image recorder 24. In an instance where the sheet 12 floats above the platen 42 on the downstream side of the recording heads 38 in the sheet conveyance direction, the sheet comes into contact with the spur rollers 88. With this configuration, when the sheet 12 floats above the platen 42, the ink attached to the sheet 12 is prevented from adhering to the lower surface 22A of the distance-defining member 22.

Controller 130

Referring next to FIG. 7, an overall structure of the controller 130 will be explained. The controller 130 moves the distance-defining member 22 and the cap 114 in order described later, so that the present disclosure is effectuated. The controller 130 controls an overall operation of the ink-jet printer 10. The controller 130 includes a CPU 131, a ROM 132, a RAM 133, an EEPROM 134, an ASIC 135, and an internal bus 137 that connects these components to one another.

The ROM 132 stores programs according to which the CPU131 controls various operations. The RAM 133 is utilized as a storage area for temporarily storing data, signals and the like to be used by the CPU131 when the CPU 131 executes the programs. The EEPROM 134 stores settings, flags and the like to be retained after the ink-jet printer 10 is turned off.

The conveyance motor 161, the sheet supply motor 162, and the sheet-supporter motor 163 are connected to the ASIC135. The ASIC135 incorporates drive circuits for controlling the respective motors. When a drive signal for rotating a predetermined motor is input from the CPU131 to the corresponding drive circuit, a drive current in accordance with the drive signal is output from the drive circuit to the corresponding motor, so that the motor rotates. That is, the controller 130 controls the motors 161, 162, 163.

The piezoelectric elements 45 are connected to the ASIC135. The piezoelectric elements 45 are activated by electric power supply from the controller 130 via drive circuits (not shown). The controller 130 controls electric power supply to the piezoelectric elements 45 so as to permit the ink droplets to be ejected from the nozzles 39.

As shown in FIG. 6A, the cap 114 does not cover the nozzles 39 in a state in which an image recording operation is performed on the sheet 12. That is, the cap 114 is located at the distant position. In this state, the sheet supporter 23 needs to support the sheet 12. Consequently, the sheet supporter 23 is located at the opposed position. Further, the distance-defining member 22 needs to appropriately define the distance between the sheet 12 and the image recorder 24 in an instance where the sheet 12 floats above the platen 42. Consequently, in the state described above, the distance-defining member 22 is located at the first position. Further, in the state described above, the cap 114 is located at the distant position.

When the image recording operation is performed on the sheet 12, the controller 130 drives the sheet supply motor 162 so as to rotate the sheet supply roller 25, whereby the uppermost one of the sheets 12 supported on the sheet tray 20 is supplied to the curved path 66. The controller 130 then drives the conveyance motor 161 so as to rotate the conveyance roller 60 and the discharge roller 62, whereby the conveyance roller pair 59 and the discharge roller pair 44 nip the sheet 12 supplied to the curved path 66 and convey the sheet 12 through the straight path 67. The controller 130 controls the piezoelectric elements 45 at timing when the sheet 12 passes right under the nozzles 39, whereby an image is recorded on the sheet 12. Subsequently, the sheet 12 is conveyed through the discharge path 68 by the discharge roller pair 44 and discharged onto the upper surface 33 of the housing 11.

In a state in which the image recording operation is not performed on the sheet 12, the nozzles 39 are normally covered by the cap 114. That is, the cap 114 is located at the contact position. It is noted that a purging operation may be performed in a state in which the nozzles 39 are covered by the cap 114.

When the image recording operation on the sheet 12 is completed, the cap 114 is moved to the contact position under the control of the controller 130. The distance-defining member 22 located at the first position overlaps the region 54 when viewed from the up-down direction 7, and therefore the cap 114 cannot be located at the contact position in a state in which the distance-defining member 22 is located at the first position.

The controller 130 drives the sheet-supporter motor 163 to cause the sheet supporter 23 to be moved from the opposed position to the retracted position, so that the distance-defining member 22 is moved from the first position to the second position. The distance-defining member 22 located at the second position does not overlap the region 54 when viewed from the up-down direction 7, and therefore the cap 114 can be located at the contact position in a state in which the distance-defining member 22 is located at the second position. Thus, after the sheet supporter 23 has been moved from the opposed position to the retracted position, namely, after the distance-defining member 22 has been moved from the first position to the second position, the controller 130 drives the sheet supply motor 162 such that the drive force is transmitted from the sheet supply motor 162 to the cam mechanism 112, so that the cap 114 is moved from the distant position to the contact position.

Advantageous Effects

According to the illustrated embodiment, after the distance-defining member 22 has been moved from the first position to the second position, the cap 114 is moved from the distant position to the contact position, so that the cap 114 covers the nozzles 39 without being disturbed by the distance-defining member 22.

According to the illustrated embodiment, the sheet supporter 23 supports the distance-defining member 22, and the distance-defining member 22 is moved by the movement of the sheet supporter 23. That is, it is not necessary to provide moving mechanisms individually for the sheet supporter 23 and the distance-defining member 22.

According to the illustrated embodiment, the distance-defining member 22 located at the first position is positioned relative to the image recorder 24 by contact with the image recorder 24. Consequently, the distance between the sheet 12 contacting the distance-defining member 22 and the nozzles 39 of the image recorder 24 can be kept constant.

According to the illustrated embodiment, the distance-defining member 22 contacts the image recorder 24 at a plurality of locations (i.e., the first contact portions 85 and the second contact portions 86). Thus, the distance-defining member 22 is kept in place with high stability.

According to the embodiment, the first contact portions 85 are disposed between the lower surface of the image recorder 24 and the sheet supporter 23, whereby the distance-defining member 22 is kept in place with high stability in the vicinity of the nozzles 39.

According to the illustrated embodiment, the sheet supporter 23 includes the first coil springs 46 which bias the distance-defining member 22 located at the first position toward the image recorder 24. It is consequently possible to permit the distance-defining member 22 to be in contact with and positioned relative to the image recorder 24 with a simple structure.

According to the illustrated embodiment, in a state in which the sheet 12 having a thickness larger than the clearance between the distance-defining member 22 and the platen 42, is located in the clearance, the platen 42 is moved downward against the biasing force of the second coil springs 47 while the distance-defining member 22 is kept in contact with the image recorder 24. With this configuration, the distance-defining member 22 is kept in place with high stability irrespective of the thickness of the sheet 12.

According to the illustrated embodiment, the distance-defining member 22 continuously extends from the upstream side to the downstream side of the nozzles in the conveyance direction 15, outside the nozzles 39 in the front-rear direction 8. This configuration avoids a situation in which the distance between the sheet 12 and the nozzles 39 varies depending upon the position in the front-rear direction 8.

According to the illustrated embodiment, the distance-defining member 22 includes the first guide 81, whereby the position of the sheet 12 is stabilized before the sheet 12 is conveyed to a position at which the sheet 12 is opposed to the nozzles 39.

According to the illustrated embodiment, the distance-defining member 22 includes the first guide 81 and the second guide 82. This configuration avoids a situation in which the clearance between the sheet 12 and the nozzles 39 varies depending upon the position in the conveyance direction 15.

According to the illustrated embodiment, the second guide 82 includes the spur rollers 88, whereby an area of contact of the second guide 82 and the sheet 12 to which the ink has been attached is reduced. Thus, the ink attached to the sheet 12 is prevented or suppressed from attaching to the second guide 82.

According to the illustrated embodiment, the second guide 82 is rendered water-repellent. Thus, the ink attached to the sheet 12 is prevented or suppressed from attaching to the second guide 82.

According to the illustrated embodiment, the distance-defining member 22 includes the third guides 83. It is consequently possible to exert an influence of contact of the distance-defining member 22 with the sheet 12 to the vicinity of the nozzles 39, so that the distance between the sheet 12 and the nozzles 39 can be made constant.

Modifications

In the illustrated embodiment, the platen 42 is positioned in the up-down direction 7 relative to the image recorder 24 by contacting the distance-defining member 22 which is positioned by contacting the image recorder 24. The platen 42 may be positioned in the up-down direction 7 by directly contacting the image recorder 24. In a configuration shown in FIG. 8, protruding portions 89 that protrude from the rear end portion of the platen 42 in the conveyance direction 15 contact the lower surface of the image recorder 24 (i.e., the second lower surface 35 of the frame 37).

Figure 8:
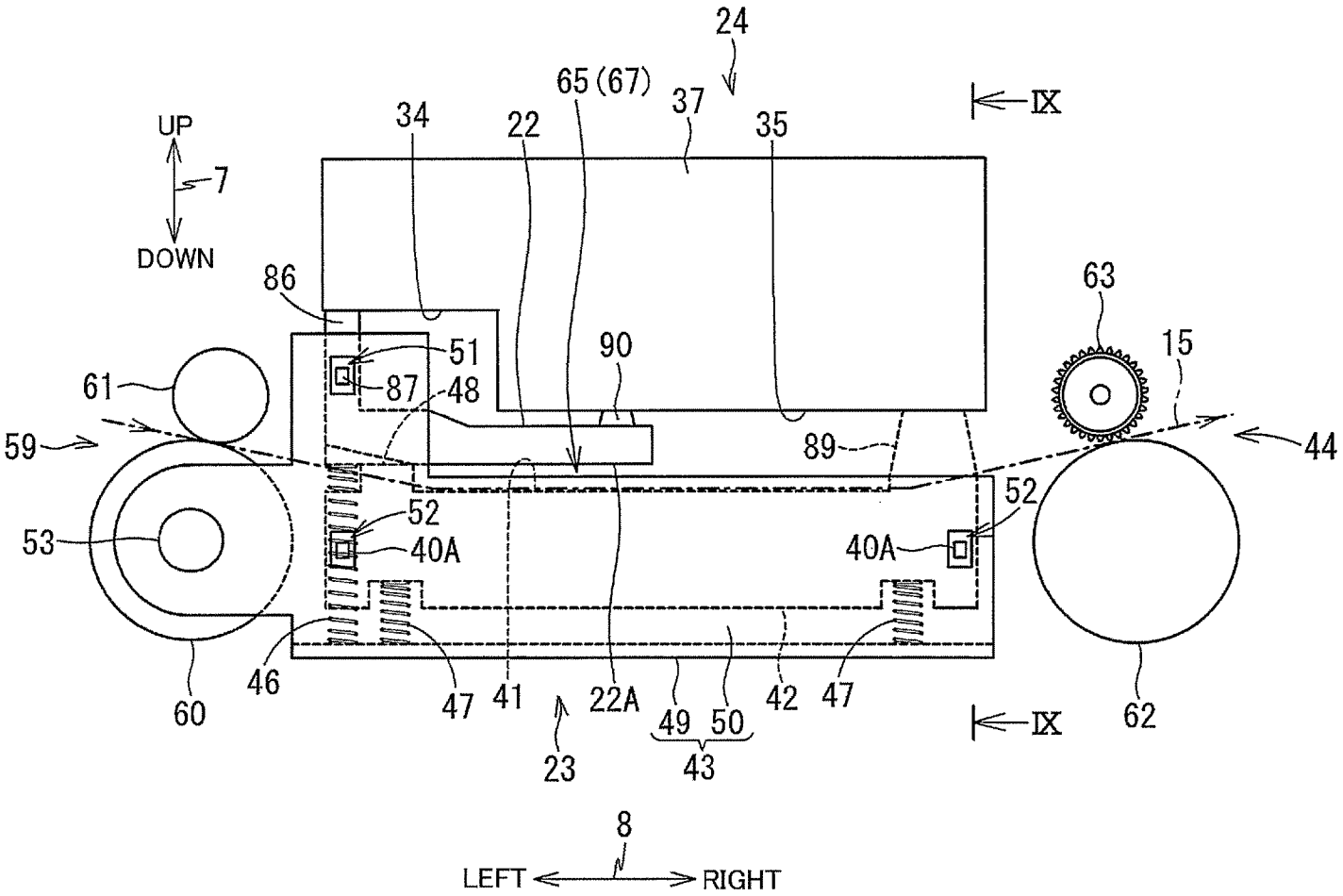
FIG. 8 is an elevational view in vertical cross section schematically showing the image recorder, the distance-defining member located at the first position, the sheet supporter located at the opposed position, the conveyance roller pair, and the discharge roller pair, according to a modification.

According to the configuration shown in FIG. 8, the platen 42 is positioned by directly contacting the image recorder 24, so that the distance between the platen 42 and the nozzle 39 of the image recorder 24 can be made constant.

According to the illustrated embodiment, the distance-defining member 22 includes the first guide 81, the second guide 82, the third guides 83, and the fourth guide 84, whereby the distance-defining member 22 continuously extends from the upstream side to the downstream side of the nozzles 39 in the conveyance direction 15, as shown in FIG. 5. The distance-defining member 22 does not necessarily include all of the first guide 81, the second guide 82, the third guides 83, and the fourth guide 84.

Figure 9:
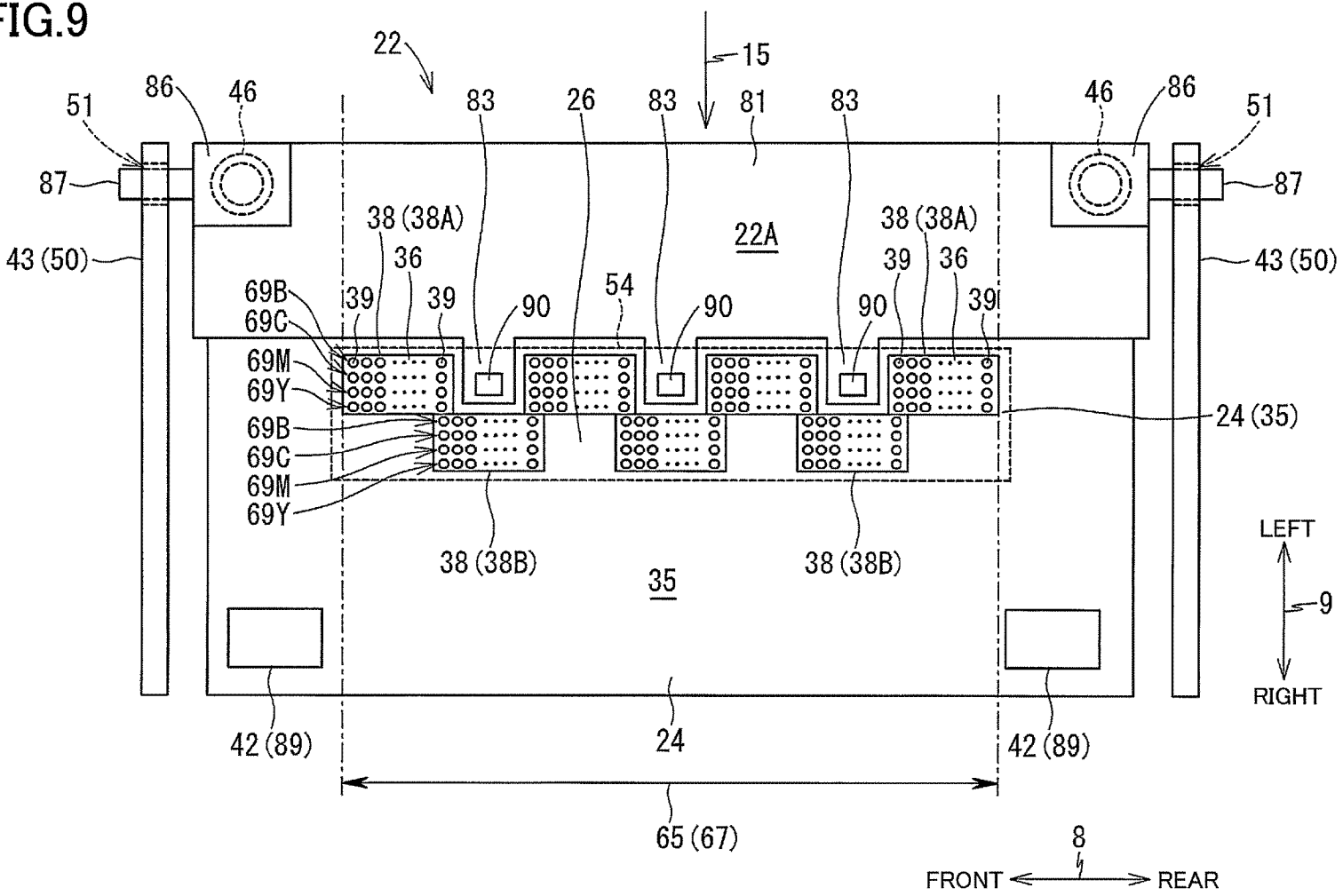
FIG. 9 is a cross-sectional view taken along line IX-IX in FIG. 8.

As shown in FIGS. 8 and 9, the distance-defining member 22 may be configured to include the first guide 81 and the third guides 83 but not to include and the second guide 82 and the fourth guide 84. In the configuration of FIGS. 8 and 9, each third guide 83 of the distance-defining member 22 includes a protrusion 90 (as one example of "first contact portion") protruding upward from its distal portion (i.e., its downstream end in the conveyance direction 15). An upper surface of the protrusion 90 contacts the lower surface of the image recorder 24 (i.e., the second lower surface 35 of the frame 37).

Figure 10A:
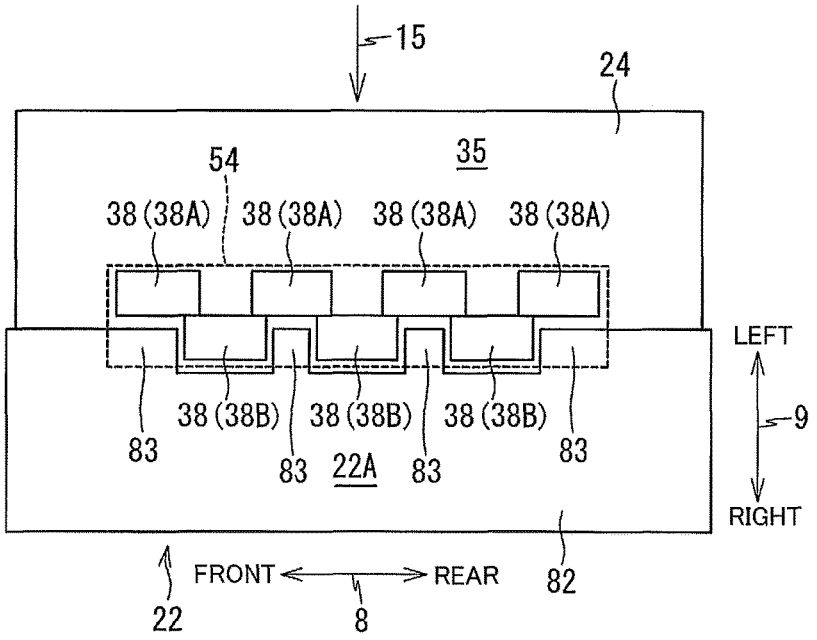
FIGS. 10A and 10B are bottom plan views schematically showing the distance-defining member and the image recorder according to another modification.

As shown in FIG. 10A, the distance-defining member 22 may be configured to include the second guide 82 and the third guides 83 but not to include the first guide 81 and the fourth guide 84. In this configuration, each third guide 83 corresponds to a portion of the distance-defining member 22, which portion protrudes from an upstream end of the second guide 82 in the conveyance direction 15 toward the upstream side in the conveyance direction 15. Each third guide 83 extends to a position which is located between corresponding two of the second recording heads 38B adjacent to each other in the front-rear direction 8 and which is located downstream of the corresponding first recording head 38A in the conveyance direction 15. Each third guide 83 overlaps the region 54 when viewed from the up-down direction 7.

Figure 10B:
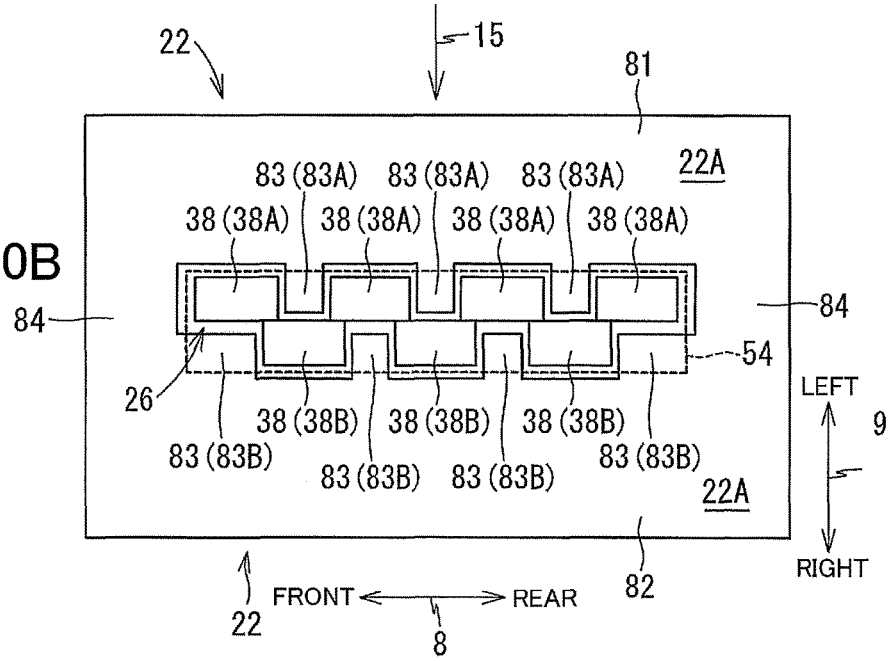

As shown in FIG. 10B, the distance-defining member 22 may include, as each third guide 83, a guide portion 83A which protrudes from a downstream end of the first guide 81 in the conveyance direction 15 toward the downstream side in the conveyance direction 15 and a guide portion 83B which protrudes from an upstream end of the second guide 82 in the conveyance direction 15 toward the upstream side in the conveyance direction 15.

In the distance-defining member 22 of the illustrated embodiment, the first guide 81, the second guide 82, the third guides 83, and the fourth guide 84 are formed integrally with each other. The distance-defining member 22 may be constituted such that the guides 81-84 are formed separately. For instance, the distance-defining member 22 may be constituted by the first guide 81 and the second guide 82, and the first guide 81 and the second guide 82 may be formed separately.

In the illustrated embodiment, the distance-defining member 22 is attached to the first coil springs 46. With this configuration, the distance-defining member 22 pivots together with the sheet supporter 23. The distance-defining member 22 may be configured to move independently of the sheet supporter 23 without being attached to the sheet supporter 23.

For instance, the distance-defining member 22 may be configured to pivot about a shaft different from the shaft for the sheet supporter 23 so as to pivot independently of the sheet supporter 23. In this configuration, in a state in which the sheet supporter 23 is located at the opposed position, the first coil springs 46 support the distance-defining member 22 from below, whereby the distance-defining member 22 is kept located at the first position. When the sheet supporter 23 pivots from the opposed position to the retracted position, the distance-defining member 22 is no more supported by the first coil springs 46. Consequently, the distance-defining member 22 pivots, by its own weight, from the first position to the second position. In this configuration, the sheet supporter 23 supports the distance-defining member 22 only when the sheet supporter 23 is located at the opposed position.

In the illustrated embodiment, the distance-defining member 22 and the platen 42 are positioned relative to the image recorder 24 by directly or indirectly contacting the image recorder 24. The distance-defining member 22 and the platen 42 may be positioned by contacting other member except the image recorder 24. For instance, the distance-defining member 22 and the platen 42 may be positioned relative to the support frame 43 by contacting the support frame 43.

In the illustrated embodiment, the sheet supporter 23 moves, by pivoting, between the opposed position and the retracted position, and the distance-defining member 22 moves, by pivoting, between the first position and the second position. The sheet supporter 23 and the distance-defining member 22 may move other than by pivoting. For instance, the sheet supporter 23 and the distance-defining member 22 may be configured to slide in the right-left direction 9 or the front-rear direction 8, instead of pivoting.

In the illustrated embodiment, the cap 114 moves to the contact position by entering a space formed after the sheet supporter 23 and the distance-defining member 22 have moved. The ink-jet printer 10 may be configured such that the sheet supporter 23 does not move and only the distance-defining member 22 moves between the first position and the second position.

For instance, the cap 114 may move to the contact position by entering a space formed after the image recorder 24 has moved upward from an image recording position at which the image recording operation on the sheet 12 is performable.

In the above case, the cap 114 at the distant position is located forward of the image recorder 24. The cap 114 moves rearward so as to enter below the image recorder 24 that has moved upward from the image recording position. Thus, the cap 114 moves from the distant position to the contact position. The distance-defining member 22 at the second position is located rearward of the image recorder 24. The distance-defining member 22 moves forward and enters below the image recorder 24 which is located at the image recording position. Thus, the distance-defining member 22 moves from the second position to the first position. A space occupied by the distance-defining member 22 when located at the first position and a space occupied by the cap 114 when located at the contact position at least partially overlap. That is, when the distance-defining member 22 is located at the first position, the cap 114 cannot move to the contact position.

When the image recording operation is performed on the sheet 12, the distance-defining member 22 is located at the first position while the cap 114 is located at the distant position. Thereafter, the image recorder 24 moves upward from the image recording position and the distance-defining member 22 moves from the first position to the second position, so that a space between the image recorder 24 and the sheet supporter 23 is enlarged. Thus, the cap 114 enters the enlarged space and moves to the contact position without being disturbed by the distance-defining member 22.

In the illustrated embodiment, the pinch roller 61 is disposed above and opposed to the conveyance roller 60. The positions of the conveyance roller 60 and the pinch roller 61 may be inverted. That is, the conveyance roller 60 may be disposed above and opposed to the pinch roller 61.

The ink-jet printer 10 may be configured such that the pinch roller 61 is movable between: a third position at which the pinch roller 61 is in contact with the conveyance roller 60; and a fourth position at which the pinch roller 61 is distant from the conveyance roller 60. Further, the ink-jet printer 10 may be configured such that the platen 42 is movable between: a fifth position at which the image recording operation on the sheet 12 is performable; and a sixth position at which the platen 42 is more distant from the image recorder 24 when located at the fifth position.

Figure 11B:
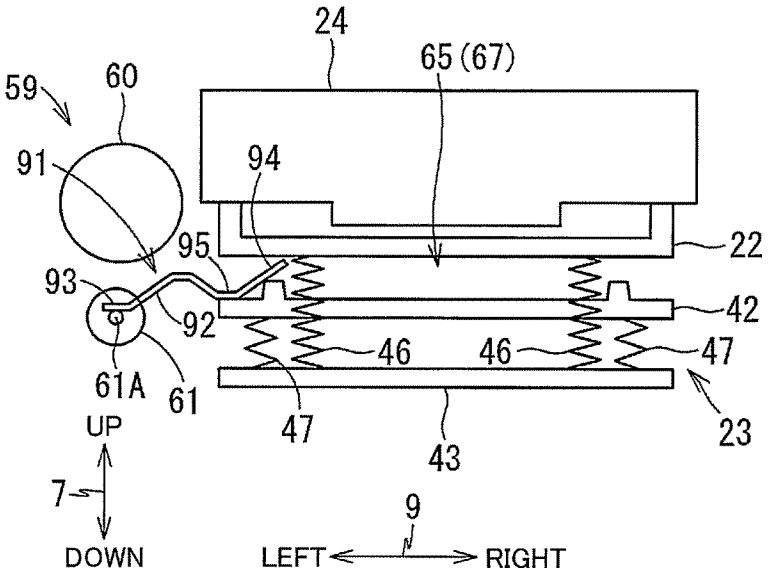
FIGS. 11A and 11B are elevational views in vertical cross section schematically showing the image recorder, the distance-defining member, the sheet supporter 23, the conveyance roller pair 59, and the movable member 91 according to still another modification.
Figure 11A:
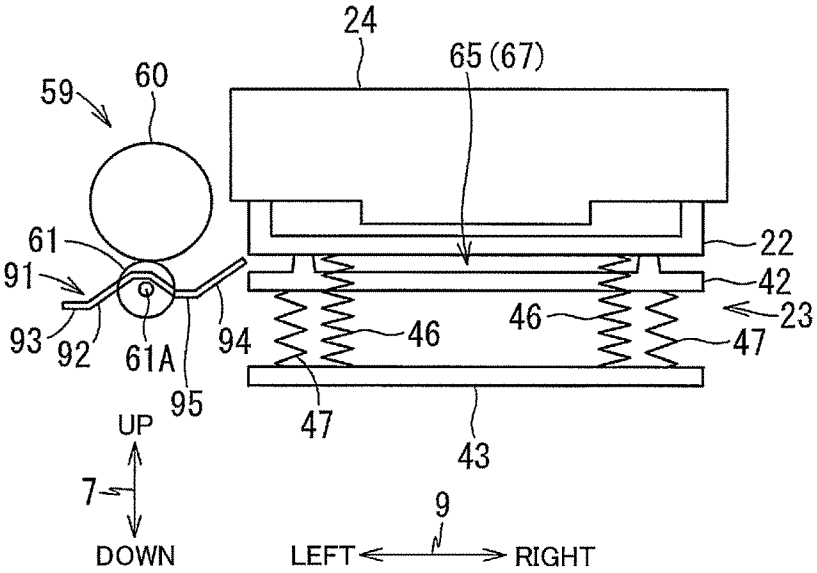

As shown in FIGS. 11A and 11B, the ink-jet printer 10 may include a movable member 91 (which functions as a third moving mechanism) which is movable in the right-left direction 9 between a left position (shown in FIG. 11A) and a right position (shown in FIG. 11B) located rightward of the left position. The movable member 91 is moved so as to move the pinch roller 61 and the platen 42. For instance, the movable member 91 is manually moved by a user who externally makes access to the movable member 91 or the movable member 91 is moved by a drive force transmitted from a motor.

The movable member 91 includes a first inclined surface 92, a first horizontal surface 93, a second inclined surface 94, and a second horizontal surface 95. The first inclined surface 92 and the first horizontal surface 93 are configured to come into contact with the shaft 61A of the pinch roller 61. The second inclined surface 94 and the second horizontal surface 95 are configured to come into contact with the platen 42.

In a state in which the movable member 91 is located at the left position, the first the inclined surface 92 and the first horizontal surface 93 are not in contact with the shaft 61A of the pinch roller 61, and the second inclined surface 94 and the second horizontal surface 95 are not in contact with the platen 42. In this state, the pinch roller 61 is located at the third position and the platen 42 is located at the fifth position.

When the movable member 91 moves from the left position toward the right position, the first inclined surface 92 comes into contact with the shaft 61A and the shaft 61A is guided along the first inclined surface 92. Consequently, the pinch roller 61 moves from the third position to the fourth position. Further, the second inclined surface 94 comes into contact with the platen 42 and the platen 42 is guided along the second inclined surface 94. Consequently, the platen 42 moves from the fifth position to the sixth position against the biasing force of the second coil springs 47.

In a state in which the movable member 91 is located at the right position, the first horizontal surface 93 is in contact with the shaft 61A from above. Consequently, the pinch roller 61 is kept located at the fourth position. Further, in the state in which the movable member 91 is located at the right position, the second horizontal surface 95 is in contact with the platen 42 from above. Consequently, the platen 42 is kept located at the sixth position.

According to the configuration shown in FIGS. 11A and 11B, the distance-defining member 22 is supported by the support frame 43 through the first coil springs 46. With this configuration, even when the pinch roller 61 and the platen 42 are moved by the movable member 91, the distance-defining member 22 does not move. Consequently, even when the pinch roller 61 and the platen 42 are moved downward so as to permit the sheet 12 having a relatively large thickness to be conveyed, for instance, the distance-defining member 22 is kept in place with high stability.

What is claimed is:

1. An image recording apparatus, comprising:

a main body in which is formed a conveyance path through which a sheet is conveyed;

an image recorder disposed in the main body and having nozzles through which a liquid is ejected toward the conveyance path;

a sheet supporter movable between (a) an opposed position at which the sheet supporter is opposed to the image recorder so as to partly define the conveyance path and supports the sheet located at the conveyance path and (b) a retracted position at which the sheet supporter is retracted from the opposed position so as not to partly define the conveyance path;

a cap movable between (c) a contact position at which the cap is located at the conveyance path and held in contact with a lower surface of the image recorder so as to cover the nozzles and (d) a distant position at which the cap is retracted from the conveyance path and distant from the lower surface of the image recorder;

a distance-defining member movable between (e) a first position and (f) a second position, the distance-defining member located at the first position being configured to define a distance between an upper surface of the sheet and the lower surface of the image recorder, the first position being a position at which at least a part of the distance-defining member is located between the lower surface of the image recorder and the sheet supporter and at which at least a part of the distance-defining member overlaps a region of the cap located at the contact position, the second position being a position at which at least a part of the distance-defining member does not overlap the region of the cap located at the contact position; and a controller configured to control the cap to move from the distant position to the contact position after the sheet supporter has been moved from the opposed position to the retracted position and the distance-defining member has been moved from the first position to the second position, wherein the distance-defining member located at the first position is supported by the sheet supporter located at the opposed position, and the distance-defining member located at the first position is moved to the second position by moving the sheet supporter from the opposed position to the retracted position.

2. The image recording apparatus according to claim 1, wherein the distance-defining member located at the first position is held in contact with the image recorder so as to be positioned relative to the image recorder.

3. The image recording apparatus according to claim 2, wherein the distance-defining member includes a first contact portion and a second contact portion which are held in contact with the image recorder when the distance-defining member is located at the first position, the second contact portion being held in contact with the image recorder at a position in a conveyance direction of the sheet different from a position of contact of the first contact portion and the image recorder, when the distance-defining member is located at the first position.

4. The image recording apparatus according to claim 3, wherein the first contact portion of the distance-defining member is formed such that the first contact portion is located between the lower surface of the image recorder and the sheet supporter when the distance-defining member is located at the first position, so as to be held in contact with the lower surface of the image recorder.

5. The image recording apparatus according to claim 2, wherein the sheet supporter includes:

a platen configured to be opposed to the lower surface of the image recorder so as to support the sheet;

a support frame supporting the platen; and a first biasing member provided at the support frame and configured to bias the distance-defining member located at the first position toward the image recorder.

6. The image recording apparatus according to claim 5, wherein the sheet supporter is provided at the support frame and includes a second biasing member configured to bias the platen toward the image recorder.

7. The image recording apparatus according to claim 6, wherein the platen is configured to come into contact with the image recorder so as to be positioned relative to the image recorder.

8. The image recording apparatus according to claim 5, further comprising:

a first roller disposed upstream of the nozzles in a conveyance direction of the sheet;

a second roller disposed so as to be opposed to the first roller and configured to nip the sheet with the first roller; and a moving mechanism configured to move the second roller between (g) a third position at which the second roller is held in contact with the first roller and (h) a fourth position at which the second roller is distant from the first roller, wherein the moving mechanism is configured to position the platen at a fifth position when the second roller is located at the third position and to position the platen at a sixth position when the second roller is located at the fourth position, the sixth position being more distant from the image recorder than the fifth position.

9. The image recording apparatus according to claim 1, wherein the sheet supporter is configured to pivot so as to be moved between the opposed position and the retracted position.

10. The image recording apparatus according to claim 1, wherein the distance-defining member continuously extends from an upstream side of the nozzles to a downstream side of the nozzles in a conveyance direction of the sheet, outside the nozzles in a width direction which is orthogonal to the conveyance direction and which is parallel to the lower surface of the image recorder.

11. The image recording apparatus according to claim 1, wherein the distance-defining member includes a first guide disposed upstream of the nozzles in a conveyance direction of the sheet.

12. The image recording apparatus according to claim 11, wherein the distance-defining member further includes a second guide disposed downstream of the nozzles in the conveyance direction.

13. The image recording apparatus according to claim 12, wherein the second guide includes a spur roller configured to come into contact with the sheet.

14. The image recording apparatus according to claim 12, wherein the second guide is rendered water-repellent.

15. The image recording apparatus according to claim 1, wherein the image recorder includes a plurality of recording heads in each of which the nozzles are formed, wherein the recording heads includes:

a plurality of first recording heads disposed so as to be spaced apart from each other in a width direction which is orthogonal to a conveyance direction of the sheet and which is parallel to the lower surface of the image recorder; and a plurality of second recording heads disposed downstream of the first recording heads in the conveyance direction such that each of the second recording heads is disposed between corresponding two of the first recording heads adjacent to each other in the width direction, and wherein the distance-defining member includes a third guide configured such that, when the distance-defining member is located at the first position, the third guide is located at least one of: a position which is between two of the first recording heads adjacent to each other in the width direction and which is upstream of the second recording heads in the conveyance direction; and a position which is between two of the second recording heads adjacent to each other in the width direction and which is downstream of the first recording heads in the conveyance direction.

16. The image recording apparatus according to claim 15, wherein the distance-defining member further includes: a first guide located upstream of the first recording heads and the second recording heads when the distance-defining member is located at the first position; and a second guide located downstream of the first recording heads and the second recording heads when the distance-defining member is located at the first position, and wherein the third guide extends from at least one of the first guide and the second guide to between the two of the first recording heads adjacent to each other in the width direction or to between the two of the second recording heads adjacent to each other in the width direction.

17. The image recording apparatus according to claim 15, wherein the first guide and the second guide are connected to each other outside the nozzles in the width direction.

18. The image recording apparatus according to claim 1, wherein the image recorder includes a recording head in which the nozzles are formed, and wherein the lower surface of the image recorder includes a lower surface of the recording head.

* * * * *